US005658098A

United States Patent [19]

Woolbright

[11] Patent Number: 5,658,098

[45] Date of Patent: Aug. 19, 1997

[54] POLYMERIC RETAINING WALL BUILDING BLOCK

[75] Inventor: Mark A. Woolbright, St. Louis, Mo.

[73] Assignee: Hercules Manufacturing, Inc., St. Louis, Mo.

[21] Appl. No.: 507,809

[22] Filed: Jul. 26, 1995

[51] Int. Cl.[6] ..... E02D 29/02

[52] U.S. Cl. ..... 405/284; 405/286

[58] Field of Search ..... 405/262, 284, 405/285, 286, 287

[56] References Cited

U.S. PATENT DOCUMENTS

| | | | |
|---|---|---|---|
| D. 296,007 | 5/1988 | Forsberg | D25/116 |
| D. 296,365 | 6/1988 | Forsberg | D25/116 |
| D. 300,253 | 3/1989 | Forsberg | D25/114 |
| D. 300,254 | 3/1989 | Forsberg | D25/114 |
| D. 310,267 | 8/1990 | Zeidman | D25/113 |
| D. 347,285 | 5/1994 | Woolbright | D25/113 |
| D. 360,475 | 7/1995 | Woolbright | D25/113 |
| 2,313,363 | 3/1943 | Schmitt | 61/39 |
| 4,107,894 | 8/1978 | Mullins | 52/593 |
| 4,229,123 | 10/1980 | Heinzmann | 405/273 |
| 4,379,659 | 4/1983 | Steiner | 405/284 |
| 4,521,138 | 6/1985 | Steiner | 405/284 |
| 4,565,043 | 1/1986 | Mazzarese | 52/593 |
| 4,671,706 | 6/1987 | Giardini | 405/286 |
| 4,804,299 | 2/1989 | Forte et al. | 405/286 X |
| 4,824,293 | 4/1989 | Brown et al. | 405/286 X |
| 4,914,876 | 4/1990 | Forsberg | 52/169.4 |
| 4,917,543 | 4/1990 | Cole et al. | 405/284 X |
| 4,920,712 | 5/1990 | Dean, Jr. | 52/169.4 |
| 4,930,283 | 6/1990 | Brick | 52/611 |
| 4,982,544 | 1/1991 | Smith | 52/606 |
| 5,044,834 | 9/1991 | Janopaul, Jr. | 405/284 |
| 5,066,169 | 11/1991 | Gavin et al. | 405/284 |
| 5,072,566 | 12/1991 | Zeldman | 52/608 |
| 5,108,231 | 4/1992 | Rausch | 405/284 |
| 5,177,925 | 1/1993 | Winkler et al. | 52/607 |
| 5,214,898 | 6/1993 | Beretta | 52/606 |
| 5,277,012 | 1/1994 | Woolbright | 52/589 |
| 5,337,527 | 8/1994 | Wagenaar | 405/284 X |
| 5,425,600 | 6/1995 | Gordon | 405/284 |
| 5,499,891 | 3/1996 | Klenert | 405/284 |

FOREIGN PATENT DOCUMENTS

| | | |
|---|---|---|
| 2651258 | 8/1989 | France . |

*Primary Examiner*—William P. Neuder

*Attorney, Agent, or Firm*—Senniger, Powers, Leavitt & Roedel

[57] ABSTRACT

A polymeric retaining wall building block comprising a base, a generally upright face wall extending upward from the base, and two generally upright side walls extending upward from the base and generally rearward of the face wall. A fill receiving cavity is defined by inner surfaces of the base, face wall, and side walls for receiving fill material, such as earth, during construction of a retaining wall. The base, face wall, and side walls each have a mean thickness which is less than approximately 10% of the width of the block to maximize the volume of the fill receiving cavity, the width of the block being defined by the distance between outer surfaces of the side walls.

33 Claims, 3 Drawing Sheets

POLYMERIC RETAINING WALL BUILDING BLOCK

BACKGROUND OF THE INVENTION

This invention relates generally to retaining wall building blocks and more particularly to polymeric retaining wall building blocks.

Retaining wall building blocks are generally formed of concrete. Concrete has a relatively high density (e.g., 120 lbs/ft$^3$ to 140 lbs/ft$^3$). Because of this high density, even relatively small blocks can be quite heavy. For example, a concrete block which is 16"×12"×8" may weigh 100 lbs or more. The heavy weight of concrete blocks has been deemed necessary to resist shifting of constructed retaining wall.

A disadvantage of concrete blocks is that they are difficult to lift and move and, therefore, constructing a retaining wall of such blocks is difficult. Also, since the weight of an item being transported is often the primary factor in determining transportation costs, transporting such concrete blocks is usually quite expensive.

SUMMARY OF THE INVENTION

Among the several objects and features of this invention may be noted the provision of an improved retaining wall building block which has the advantages of concrete retaining wall building blocks without having the disadvantages of such blocks; the provision of such a retaining wall building block which is relatively light weight; the provision of such a retaining wall building block which may easily be moved, lifted, and transported; the provision of such a retaining wall building block which is relatively light-weight before construction of a retaining wall, but has an effective weight in a constructed wall which is substantially greater than its actual weight; and the provision of such a retaining wall building block which is of relatively simple construction.

Generally, a polymeric retaining wall building block of the present invention comprises a base, a generally upright face wall extending upward from the base, and two generally upright side walls extending upward from the base and generally rearward of the face wall. A fill receiving cavity is defined by inner surfaces of the base, face wall, and side walls for receiving fill material, such as earth, during construction of a retaining wall. The base, face wall, and side walls each have a mean thickness which is less than approximately 10% of the width of the block to maximize the volume of the fill receiving cavity, the width of the block being defined by the distance between outer surfaces of the side walls.

In another aspect of the present invention, a polymeric retaining wall building block of the present invention comprises a base, a generally upright face wall extending upward from the base, and two generally upright side walls extending upward from the base and generally rearward of the face wall. A fill receiving cavity is defined by inner surfaces of the base, face wall, and side walls for receiving fill material, such as earth, during construction of a retaining wall. The fill receiving cavity includes a fill volume having a height generally equal to the height of the inner surfaces of the side walls, a depth generally equal to the length of the inner surfaces of the side walls, and a width generally equal to the distance between the inner surfaces of the opposing side walls. A block volume is defined by the combined volumes of the base, face wall, side walls and fill volume. The fill volume is at least approximately 60% of the block volume.

In another aspect of the present invention, a polymeric retaining wall building block of the present invention comprises a base, a generally upright face wall extending upward from the base, and two generally upright side walls extending upward from the base and generally rearward of the face wall. At least one stud is integral with and extends from one of the base and side walls for engaging a stud receiving hole of a second block to restrict lateral movement of the building block with respect to the second block.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
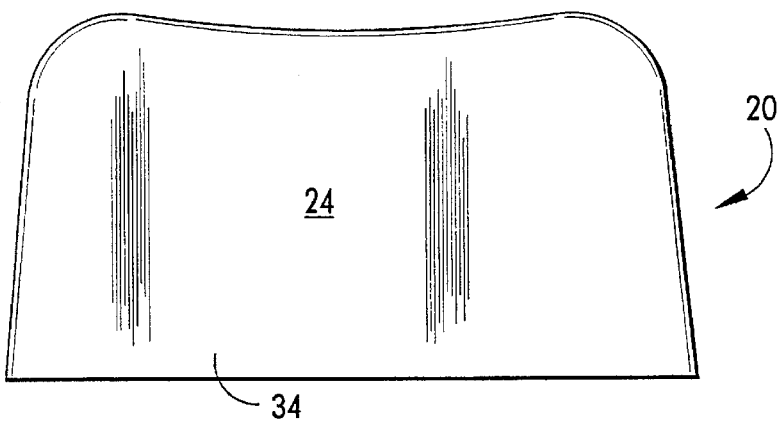
FIG. 1 is a front elevational view of a polymeric retaining wall building block of the present invention.

Referring now to the drawings, and first more particularly to FIGS. 1–4, a retaining wall building block of the present invention is indicated in its entirety by the reference numeral 20. The building block 20 is of a suitable polymeric material, such as an injection moldable polyethylene, preferably having a density of less than approximately 65 lbs/ft$^3$, and more preferably having a density of less than approximately 50 lbs/ft$^3$, and most preferably having a density of less than approximately 40 lbs/ft$^3$.

Figure 2:
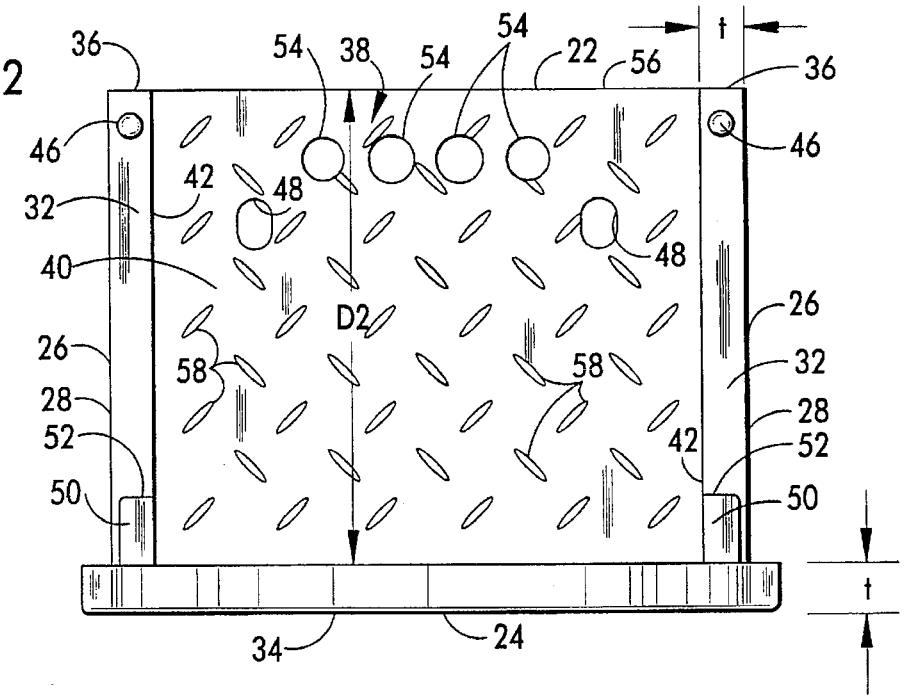
FIG. 2 is a top plan view of the building block of FIG. 1.
Figure 3:
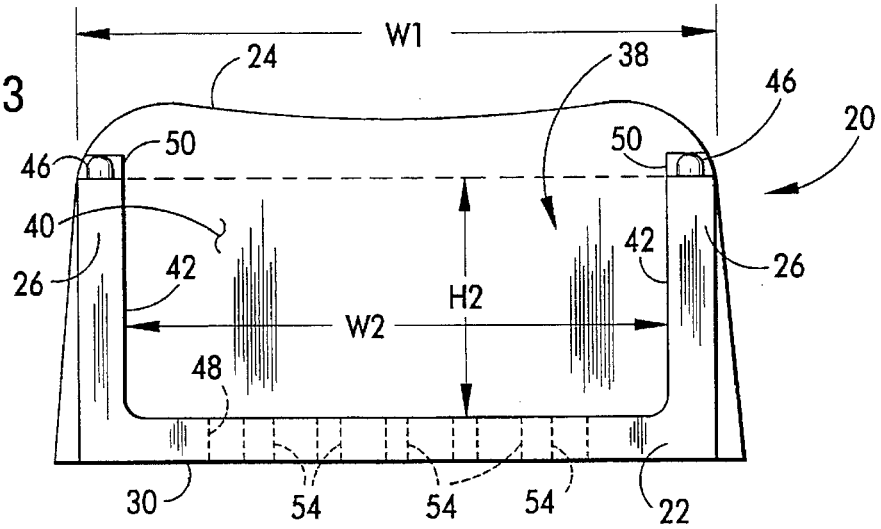
FIG. 3 is a rear elevational view of the building block of FIG. 1.
Figure 4:
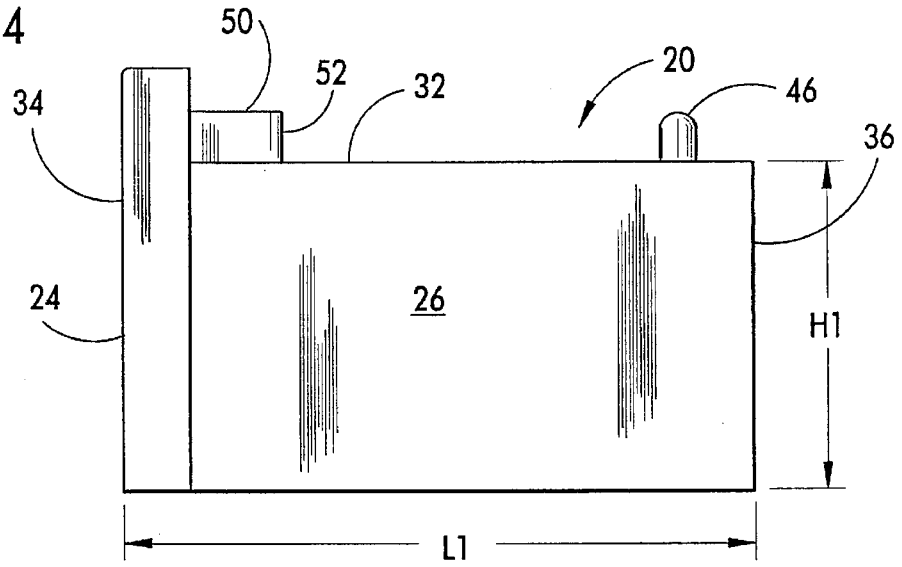
FIG. 4 is a side elevational view of the building block of FIG. 1.

The building block 20 comprises a base 22, a generally upright face wall 24 extending upward from the base, and two generally upright side walls 26 extending upward from the base and generally rearward of the face wall. The building block 20 has a width $W_1$ (FIG. 3) defined by the distance between outer surfaces 28 of the side walls 26, a side wall height $H_1$ (FIG. 4) defined by the distance between the underside 30 of the base 22 and upper edges of the side walls 26, and a length $L_1$ (FIG. 4) defined by the distance between the outer surface 34 (i.e., front face) of the face wall 24 and the rearward most ends 36 of the side walls 26. Inner surfaces of the base 22, face wall 24, and side walls define a fill receiving cavity, generally indicated at 38 (FIG. 3), for receiving fill material, such as earth, during construction of a retaining wall. The fill receiving cavity 38 includes a fill volume 40 having a width $W_2$ (FIG. 3) generally equal to the distance between inner surfaces 42 of the opposing side walls 26, a height $H_2$ generally equal to the height of the inner surfaces of the side walls, and a depth $D_2$ (FIG. 2)

generally equal to the length of the inner surfaces of the side walls. As a module in a retaining wall, the building block 20 may actually support a volume of fill material greater than the block fill volume 40. For example, in addition to holding fill material in the fill receiving cavity 38, the building block 20 supports a column of fill (not shown) extending upward above the fill receiving cavity and between blocks of a next higher course of blocks (e.g., in a space 44 between blocks 20*a* and 20*b* in FIG. 8). However, because the volume of fill material may vary from one retaining wall to another, the block fill volume 40 has been defined solely on block characteristics to simplify the explanation.

A building block must be sufficiently heavy to provide necessary stability to act as a module for a retaining wall. To provide the needed weight, the fill receiving cavity 38 of the polymeric building block 20 has a large fill volume 40 to receive a large amount of fill material. Typical fill material has a density of approximately 100 lbs/ft$^3$, which is significantly greater than the density of the polymeric material of the building block 20 which preferably has a density between 35 and 65 lbs/ft$^3$. Thus, a building block 20 filled with fill material has an effective density which is greater than the density of the polymeric material of the building block. For purposes of discussion, the building block effective density equals the sum of the weight of block material (i.e., the weight of the polymeric material of the building block 20) and the weight of fill material in the block fill volume 40 divided by the sum of block material volume and the block fill volume. Preferably, the block fill volume 40 of the fill receiving cavity 38 is sufficiently great that when it is filled with a fill material having a density of 100 lbs/ft$^3$, the filled building block 20 has an effective density of at least approximately 80 lbs/ft$^3$.

The base 22, face wall 24, and side walls 26 each have a mean thickness t which is preferably less than approximately 10% of the block width $W_1$, and more preferably less than approximately 8% of the block width, and most preferably less than approximately 6% of the block width to provide a relatively large fill volume 40 of the fill receiving cavity 38. Also, this mean thickness is preferably less than approximately 20% of the side wall height $H_1$, and more preferably less than approximately 15% of the side wall height. The block fill volume 40 is preferably at least approximately 60% of the block volume (i.e., the combined volumes of the base 22, face wall 24, side walls 26 and fill volume 40), and more preferably at least approximately 65% of the block volume.

In an exemplary building block 20, the width $W_1$ is 16", the face wall 24 height is 8.5", the side wall height $H_1$ is 6.5", and the length $L_1$ is 12". Also, the base 22, face wall 24, and side walls 26 each have a mean thickness of approximately ⅞" to 1". This exemplary building block 20 has a block volume of approximately 0.75 ft$^3$ and a block fill volume 40 of approximately 0.5 ft$^3$. In this example, the building block 20 is made of a polymeric material having a density of 40 lbs/ft$^3$ and, therefore, its weight without fill is about 10 lbs. If the fill volume 40 of the building block 20 is filled with a fill material having a density of 100 lbs/ft$^3$, the effective density of the filled building block is approximately 80 lbs/ft$^3$. Thus, the building block 20 is relatively light-weight in its unfilled state and therefore easily transported and lifted, but is sufficiently heavy in its filled state to act as a retaining wall module.

Figure 6:
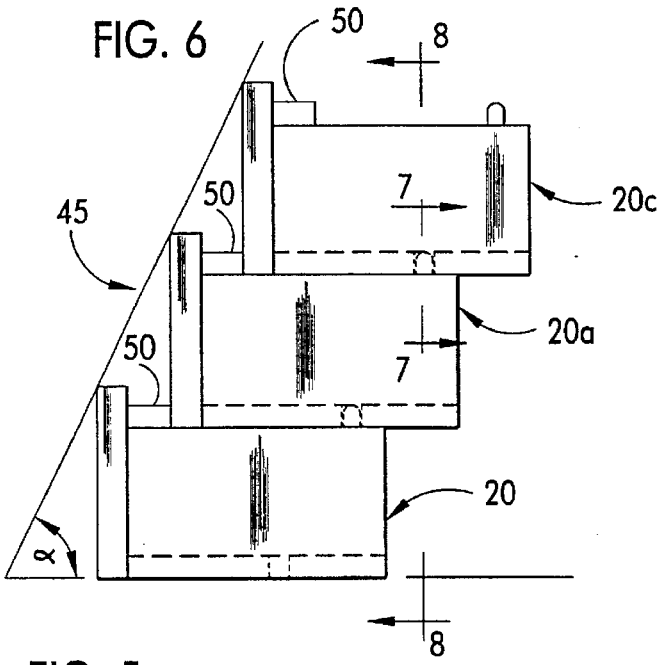
FIG. 6 is a side elevational view of the retaining wall of FIG. 5.
Figure 7:
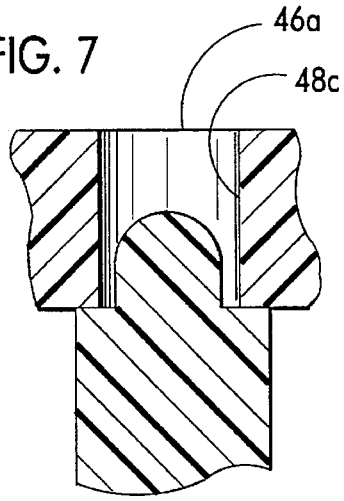
FIG. 7 is a fragmented cross-sectional view taken along the plane of line 7—7 of FIG. 6.
Figure 5:
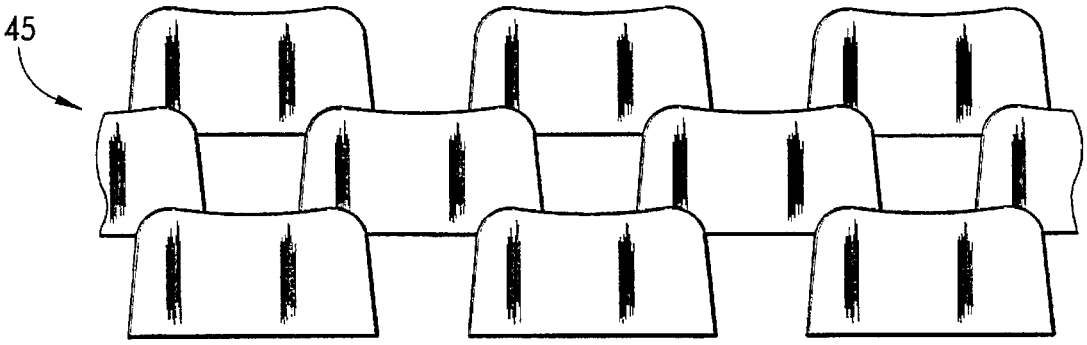
FIG. 5 is a front elevational view of a retaining wall constructed of retaining wall building blocks of FIG. 1 but with fill material omitted to show detail.
Figure 8:
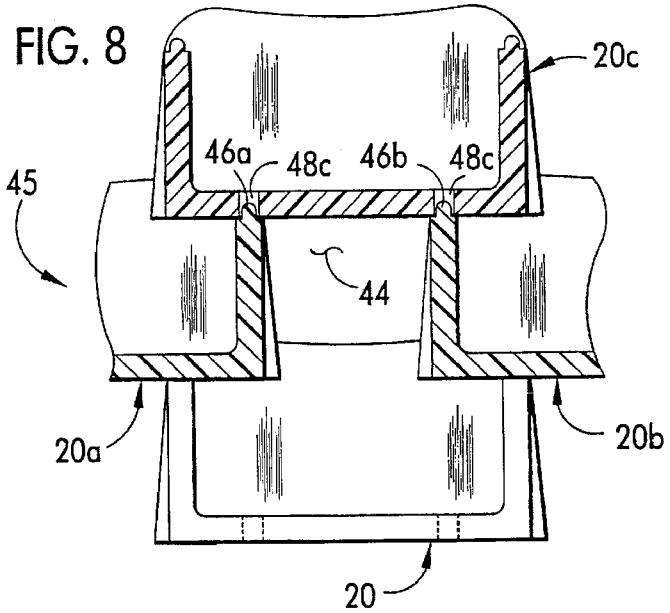
FIG. 8 is a cross-sectional view taken along the plane of line 8—8 of FIG. 6.

Referring now to FIGS. 6–8 which show a retaining wall, generally indicated at 45, constructed of building blocks of the present invention. To show detail, the retaining wall 45 is shown without fill material. Also, although the retaining wall 45 is shown with only three courses of blocks, it is to be understood that retaining walls with more or fewer courses could also be constructed with the building blocks of the present invention.

The building block 20 further comprises two studs 46 integral with and extending upward from the upper edges 32 of the side walls 26 and two stud receiving holes 48 (see FIG. 2) in the base 22. The studs 46 are engageable with stud receiving holes of adjacent blocks positioned on the building block 20. The stud receiving holes 48 receive studs of adjacent blocks positioned under the building block. As shown in FIG. 8, studs 46*a* and 46*b* of blocks 20*a* and 20*b* engage stud receiving holes 48*c* of block 20*c* positioned on building blocks 20*a* and 20*b*. The stud receiving holes (not shown) of blocks 20*a* and 20*b* receive the studs of building block 20 positioned under blocks 20*a* and 20*b*. The studs 46 and stud receiving holes 48 interlock blocks of adjacent courses of the retaining wall 45 and restrict relative lateral movement therebetween. The studs 46 and holes 48 provide a predetermined spacing between blocks of adjacent courses of the retaining wall 45 and prevent the light-weight blocks from sliding prior to being filled with fill material. Preferably, the studs 46 are adapted to be readily sheared or otherwise broken from their corresponding side walls 26 when the block 20 is to be used in curved portions (not shown) of the retaining wall. The building block 20 further includes set-back tabs 50 extending upward from the upper edges 32 of the side walls 26 and rearward of the face wall 24. The set-back tabs 50 define shoulders 52 engageable with face walls of blocks positioned on the building block 20 to restrict forward movement of these blocks relative to the building block. The set-back tabs 50 are sized to provide a predetermined slope $\alpha$ (FIG. 6), e.g. 70°, of the retaining wall 45 when the face walls of blocks of a higher adjacent course abut the shoulders 52. Preferably, the tabs 50 are sized so that the slope $\alpha$ is between 50° and 80°. Also, the polymeric material of the building block 20 is preferably such that the set-back tabs 50 may be cut (i.e., rearward portions thereof removed) to effectively shorten the set-back tabs and thus change the slope of a wall constructed with such modified blocks. Although shown with only two stud receiving holes 48 (see FIG. 2), it is to be understood that the building block 20 could alternatively be provided with additional stud receiving holes (not shown) forward of stud receiving holes 48 to permit construction of retaining walls of various slopes. It is also to be understood that the building block 20 could alternatively be provided with more than or less 2 studs.

The building block 20 further includes a plurality of root-receiving holes 54 in the base 22 through which roots of vegetation (not shown) may grow when the building block is part of a retaining wall. Such vegetation may further anchor the building block 20 to prevent shifting of the constructed retaining wall. Preferably, the root-receiving holes 54 are adjacent the rear edge 56 of the base 22 to form a carrying handle by which a user may extend his or her fingers through the holes and thereby grasp the building block 20. Thus, prior to construction of the retaining wall, the root-receiving holes 54 constitute a handle for carrying the building block 20. The building block 20 further includes a plurality of indentations 58 in the upper surface of the base 22 to retain moisture from the fill material.

Figure 9:
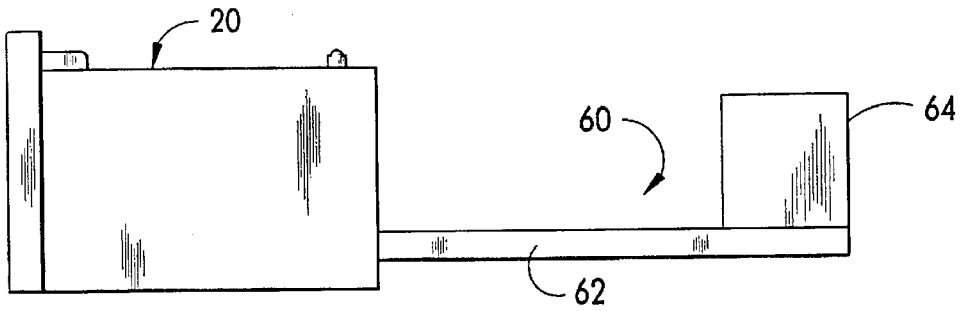
FIG. 9 is a side elevational view of the block of FIG. 1 with an anchoring mechanism attached thereto.
Figure 10:
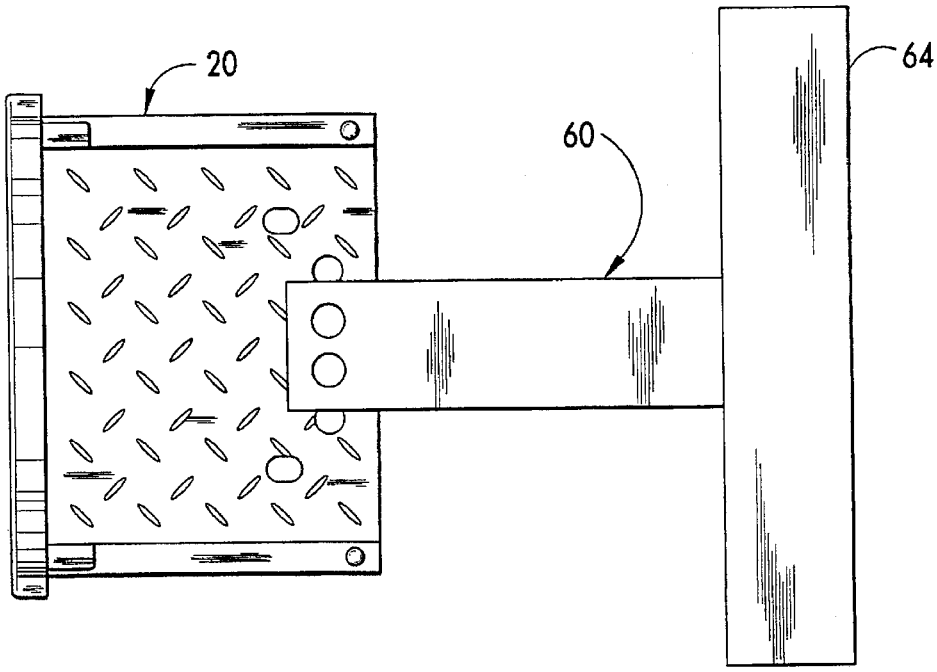
FIG. 10 is a top plan view of the block and anchoring mechanism of FIG. 9.

Referring now to FIGS. 9 and 10, an anchoring mechanism ("deadman"), generally indicated at 60, may be secured to a rearward portion of the base 22 to further anchor the retaining wall. The anchoring mechanism 60 comprises a rearwardly extending polymeric stringer 62 and a polymeric cross-member 64 secured to a rear end of the stringer. The stringer 62 may be pinned to the building block 20 via one of the root-receiving holes 54 or may otherwise be fastened (e.g., by nails or staples) to the building block. Preferably, the stringer 62 and the building block 20 are both formed of a nailable polymeric material into which a nail may be readily driven (e.g., via a conventional hammer) to secure the stringer to the building block.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A polymeric retaining wall building block comprising:

a base;

a generally upright face wall extending upward from the base;

two generally upright side walls extending upward from the base and generally rearward of the face wall;

a fill receiving cavity defined by the base, face wall, and side walls for receiving fill material, such as earth, during construction of a retaining wall, the base extending under the fill receiving cavity;

the base, face wall, and side walls each having a mean thickness which is less than approximately 10% of the width of the block to maximize the volume of the fill receiving cavity, the width of the block being defined by the distance between outer surfaces of the side walls.

2. A retaining wall building block as set forth in claim 1 wherein the base, face wall, and side walls each have a mean thickness which is less than approximately 20% of the height of the side walls.

3. A retaining wall building block as set forth in claim 1 wherein the base, face wall, and side walls are of a polymeric material having a density of less than approximately 65 lbs/ft$^3$.

4. A retaining wall building block as set forth in claim 3 where in the volume of the fill receiving cavity is sufficiently great that when the fill receiving cavity is filled with a fill material having a density of 100 lbs/ft$^3$, the filled block has an effective density of at least approximately 80 lbs/ft$^3$.

5. A retaining wall building block as set forth in claim 4 wherein the base, face wall, and side walls are of a polymeric material having a density of less than approximately 50 lbs/ft$^3$.

6. A retaining wall building block as set forth in claim 1 further comprising at least one stud integral with and extending up from one of the side walls, the stud being engageable with a stud receiving hole of a second block when said second block is positioned generally on the building block for restricting lateral movement of said second block relative to the building block.

7. A retaining wall building block as set forth in claim 6 further comprising a stud receiving hole in the base for receiving a stud of a third block when the building block is positioned generally on said third block to restrict lateral movement of the building block with respect to said third block.

8. A retaining wall building block as set forth in claim 6 further comprising a second stud integral with and extending up from the other of the side walls, the stud being engageable with a second stud receiving hole of a second block when said second block is positioned generally on the building block for restricting lateral movement of said second block relative to the building block, the second stud being configured such that the stud may be broken off to allow the second block to be positioned at an angle relative to the first block.

9. A retaining wall building block as set forth in claim 1 further comprising at least one set-back tab generally above one of the side walls and generally rearward of the face wall, the set-back tab defining a shoulder engageable with a face wall of a second block to restrict forward movement of said second block relative to the building block when said second block is positioned generally on the building block, the set-back tab being configured such that the set back-tab may be trimmed to adjust the relative position of said second block.

10. A retaining wall building block as set forth in claim 1 wherein the base, face wall and side walls are integrally formed as a single unit.

11. A retaining wall building block as set forth in claim 1 wherein said base, face wall and side walls each include an inner surface generally facing the fill receiving cavity and an outer surface spaced from said inner surface and material extending between said inner and outer wall consisting essentially of a polymeric material.

12. A retaining wall building block as set forth in claim 1 wherein said face wall and side walls each have a height of less than one foot and the front wall has a length of less than two feet.

13. A polymeric retaining wall building block comprising:

a base;

a generally upright face wall extending upward from the base;

two generally upright side walls extending upward from the base and generally rearward of the face wall;

the base, face wall and side walls being integrally formed as a single unit;

at least one stud integral with and extending from one of the side walls for engaging a stud receiving hole of a second block to restrict lateral movement of the building block with respect to said second block;

a fill receiving cavity defined by the base, face wall, and side walls for receiving fill material, such as earth, during construction of a retaining wall, the fill receiving cavity including a fill volume having a height generally equal to the height of the inner surfaces of the side walls, a depth generally equal to the length of the inner surfaces of the side walls, and a width generally equal to the distance between the inner surfaces of the opposing side walls;

said base, face wall, and side walls having an inner surface generally facing the fill receiving cavity and an outer surface spaced from said inner surface and material extending between said inner and outer surfaces consisting essentially of a polymeric material having a density of less than approximately 65 lbs/ft$^3$;

a block volume defined by the combined volumes of the base, face wall, side walls and fill volume;

the fill volume being at least approximately 60% of the block volume.

14. A retaining wall building block as set forth in claim 13 wherein the fill volume is at least approximately 65% of the block volume.

15. A retaining wall building block as set forth in claim 13 wherein the base, face wall, and side walls are of a polymeric material having a density of less than approximately 65 lbs/ft$^3$.

16. A retaining wall building block as set forth in claim 15 wherein the volume of the fill receiving cavity is sufficiently great that when it is filled with a fill material having a density of 100 lbs/ft$^3$, the filled block has an effective density of at least approximately 80 lbs/ft$^3$.

17. A retaining wall building block as set forth in claim 13 wherein the base, face wall, and side walls each have a mean thickness which is less than approximately 10% of the width of the block, the width of the block being defined by the distance between outer surfaces of the side walls.

18. A polymeric retaining wall building block comprising:

a base;

a generally upright face wall extending upward from the base;

two generally upright side walls extending upward from the base and generally rearward of the face wall;

a fill receiving cavity defined by the base, face wall, and side walls for receiving fill material, such as earth, during construction of a retaining wall, the fill receiving cavity having a fill volume sufficiently great that when it is filled with a fill material having a density of 100 lbs/ft$^3$, the filled block has an effective density of at least approximately 80 lbs/ft$^3$;

said base, face wall, and side walls each having an inner surface generally facing the fill receiving cavity, an outer surface spaced from the inner surface and material extending between the inner and outer surfaces, the surfaces and the material being of a polymeric material having a density of less than approximately 65 lbs/ft$^3$.

19. A retaining wall building block as set forth in claim 18 wherein the base, face wall, and side walls are of a polymeric material having a density of less than approximately 60 lbs/ft$^3$.

20. A retaining wall building block as set forth in claim 19 wherein the base, face wall, and side walls are of a polymeric material having a density of less than approximately 50 lbs/ft$^3$.

21. A retaining wall building block as set forth in claim 20 wherein the base, face wall, and side walls each have a mean thickness which is less than approximately 10% of the width of the block, the width of the block being defined by the distance between outer surfaces of the side walls.

22. A retaining wall building block as set forth in claim 18 further comprising at least one stud integral with and extending up from one of the side walls, the stud being engageable with a stud receiving hole of a second block when said second block is positioned generally on the building block for restricting lateral movement of said second block relative to the building block.

23. A retaining wall building block as set forth in claim 18 further comprising a plurality of root-receiving holes in the base through which roots of vegetation may grow when the building block is part of a retaining wall.

24. A retaining wall building block as set forth in claim 18 wherein the base, face wall and side walls are integrally formed as a single unit.

25. A retaining wall building block as set forth in claim 18 wherein said base, face wall and side walls each include an inner surface generally facing the fill receiving cavity and an outer surface spaced from said inner surface and material extending between said inner and outer surfaces consisting essentially of a polymeric material.

26. A polymeric retaining wall building block comprising:

a base;

a generally upright face wall extending upward from the base;

two generally upright side walls extending upward from the base and generally rearward of the face wall;

at least one stud integral with and extending upwardly from one of the side walls for engaging a stud receiving hole of a second block to restrict lateral movement of the building block with respect to said second block.

27. A retaining wall building block as set forth in claim 20 wherein the base, face wall and side walls are integrally formed as a single unit.

28. A retaining wall building block as set forth in claim 20 wherein said base, face wall and side walls each include an inner surface generally facing the fill receiving cavity and an outer surface spaced from said inner surface and material extending between said inner and outer surfaces consisting essentially of a polymeric material.

29. A polymeric retaining wall building block comprising:

a base;

a generally upright face wall extending upward from the base;

two generally upright side walls extending upward from the base and generally rearward of the face wall;

at least one stud integral with and extending from one of the side walls for engaging a stud receiving hole of a second block to restrict lateral movement of the building block with respect to said second block; and a stud receiving hole in the base for receiving a stud of a third block when the building block is positioned generally on said third block to restrict lateral movement of the building block with respect to said third block.

30. A retaining wall building block as set forth in claim 19 wherein the stud extends upward from one of the side walls.

31. A retaining wall building block as set forth in claim 30 further comprising at least one set-back tab extending generally from one of the side walls and generally rearward of the face wall, the set-back tab defining a shoulder engageable with a face wall of the second block to restrict forward movement of the second block relative to the building block when the second block is positioned generally on the building block, the set-back tab capable of being trimmed to adjust the relative position of said second block.

32. A retaining wall building block as set forth in claim 29 further comprising a plurality of root-receiving holes in the base through which roots of vegetation may grow when the building block is part of a retaining wall.

33. A retaining wall building block as set forth in claim 32 wherein the base, face wall, and side walls each have a mean thickness which is less than approximately 10% of the width of the block, the width of the block being defined by the distance between outer surfaces of the side walls.

* * * * *

UNITED STATES PATENT AND TRADEMARK OFFICE

CERTIFICATE OF CORRECTION

PATENT NO. : 5,658,098

DATED : August 19, 1997

INVENTOR(S) : Mark A. Woolbright

It is certified that error appears in the above-identified patent and that said Letters Patent is hereby corrected as shown below:

In Column 7, Claim 20, line 1 "claim 19" should read -- claim 18 --.

In Column 8, Claim 27, line 14 "claim 20" should read -- claim 26 --.

In Column 8, Claim 28, line 17 "claim 20" should read -- claim 26 --.

In Column 8, Claim 30, line 39 "claim 19" should read -- claim 29 --.

Signed and Sealed this

Twenty-fifth Day of November, 1997

*Attest:*

Bruce Lehman

BRUCE LEHMAN

*Attesting Officer*

*Commissioner of Patents and Trademarks*